US005989389A

United States Patent [19]

Sundberg

[11] Patent Number: 5,989,389

[45] **Date of Patent: *Nov. 23, 1999**

[54] METHOD OF PRODUCING VISIBLE, CONTINUOUS STREAKS AND/OR DELIMITED FIELDS IN PAPER

[75] Inventor: Tore Sundberg, Tumba, Sweden

[73] Assignee: AB Tumba Bruk, Sweden

[ * ] Notice: This patent issued on a continued prosecution application filed under 37 CFR 1.53(d), and is subject to the twenty year patent term provisions of 35 U.S.C. 154(a)(2).

[21] Appl. No.: 08/424,479

[22] PCT Filed: Nov. 9, 1993

[86] PCT No.: PCT/SE93/00949

§ 371 Date: Jun. 9, 1995

§ 102(e) Date: Jun. 9, 1995

[87] PCT Pub. No.: WO94/11577

PCT Pub. Date: May 26, 1994

[30] Foreign Application Priority Data

Nov. 11, 1992 [SE] Sweden ..... 9203370

[51] Int. Cl.[6] ..... D21H 21/26

[52] U.S. Cl. ..... 162/109; 162/103; 162/108; 162/116; 162/126; 162/127; 162/129; 162/133; 162/140; 162/146

[58] Field of Search ..... 162/103, 108, 162/116, 126, 129, 127, 133, 140, 298, 300, 301, 322, 343, 146

[56] References Cited

U.S. PATENT DOCUMENTS

| | | | |
|---|---|---|---|
| 202,483 | 4/1878 | Syms | 162/126 |
| 210,497 | 12/1878 | Casilear | 162/140 |
| 987,678 | 3/1911 | Howes | 162/140 |
| 4,162,936 | 7/1979 | Frezzotti | 162/276 |
| 4,437,935 | 3/1984 | Crane, Jr. | 162/140 |
| 4,462,866 | 7/1984 | Tooth et al. | 162/140 |
| 4,462,867 | 7/1984 | Fuller | 162/140 |
| 4,552,617 | 11/1985 | Crane | 162/140 |
| 4,943,093 | 7/1990 | Melling et al. | 162/140 |

FOREIGN PATENT DOCUMENTS

| | | | |
|---|---|---|---|
| 490825 | 6/1992 | European Pat. Off. | 162/140 |
| 1078 | 1/1895 | United Kingdom | 162/134 |
| 237828 | 8/1925 | United Kingdom | 162/140 |
| 696673 | 9/1953 | United Kingdom | 62/140 |

*Primary Examiner*—Peter Chin
*Attorney, Agent, or Firm*—Banner & Witcoff, Ltd.

[57] ABSTRACT

The invention relates to a method of producing visible, preferably transparent or translucent, continuous streaks and/or delimited fields in paper in conjunction with forming a paper web in a paper machine. The method is characterized by essentially preventing dewatering of paper stock/paper fibres on one or more surfaces of a wire in the forming unit of a paper machine in conjunction with forming a paper web in the machine, and by applying a special stock that contains fibres which differ from the other fibre material deposited on the wire, optionally together with an arbitrary filler and/or binder. The invention also relates to a valuable document, such as a banknote, produced from the aforedescribed paper.

5 Claims, 3 Drawing Sheets

METHOD OF PRODUCING VISIBLE, CONTINUOUS STREAKS AND/OR DELIMITED FIELDS IN PAPER

THE FIELD AND BACKGROUND OF THE INVENTION

The present invention relates to a method of producing visible, preferably transparent or translucent, continuous streaks and/or delimited fields in paper in conjunction with forming a paper web in a paper machine. The invention also relates to valuable paper, particularly banknotes, produced from such paper. More specifically, the invention relates to the manufacture of a continuous paper web containing delimited fields and/or streaks of varying size and in varying positions, and to valuable paper produced from such webs. The fields and/or streaks differ from the surrounding paper with regard to material, colour, opacity and/or transparency or with regard to some other readily identified property, preferably an optical property. The incorporated fields and/or streaks are preferably transparent or translucent.

The rapid development of reproduction methods and of fourcolour copiers in particular, places increasingly higher demands on the manufacturers of security paper, cheque paper and banknotes. These demands have led to the development of new methods, materials and products which are intended to prevent forgery or at least make successful forgery more difficult to achieve. Many of the methods proposed hitherto are complicated and expensive in practice and the products produced by these methods are encumbered with drawbacks, such as unsatisfactory durability.

There is thus a need for methods which will enable security paper that is difficult to forge by reproduction with the aid of colour copying and which can be printed in conventional printing presses with conventional printing inks intended for security print to be produced in a relatively simple and inexpensive manner.

PRIOR ART TECHNIQUES

In order to prevent an image or text on a basic material, such as paper, from being reproduced with the aid of simple fourcolour copying on a copier, it is desirable that parts of the irradiated surface will emit and/or reflect incident light back to the sensors or like devices provided in the copier, in a manner which differs from the reflection caused by the remaining surface of the basic material and thus capable of being discerned by an observer without the aid of technical auxiliaries, i.e. can be seen with the naked eye. Alternatively, the surface of the basic material may be treated so as to obtain a very low reflectance from the surface, which can be achieved either with high absorption or by the transmission of incident light.

These known phenomena have earlier been utilized to make forgery difficult by colour copying, for instance, different methods of obtaining discernible reflection or interference have been proposed. In the case of a distinguishing or spectacular reflection, light is reflected in parallel from a mirror image, meaning that the sensor of a photocopier will receive no signal because the reflected light lies outside its measuring range, i.e. the measured surface or area, or because the luminosity is too weak to be determined. The best known example of a distinguishing reflection is "a partially embedded security filament or thread", proposed by Portals Ltd., see for instance EP 0059056, and by The Bank of England, see SE-C 415,214. According to these known methods, there is partially embedded in the paper a thread/strip which contains a layer or coating which produces reflectance, for instance a strip containing, e.g., a metallic mirror-reflective coating. The thread/strip is exposed at mutually spaced locations. When photocopying a valuable paper in which such a thread of reflective material is partially embedded, the reflective surfaces appear as dark fields on the photocopies.

Another earlier proposed method utilizes interference between reflective light of different wavelengths. When viewing a surface that is provided with an interference material, the visible colour impression varies with the angle at which the surface is viewed. This phenomenon cannot be reproduced in a copied image or picture. Interference effects can be achieved, for instance, with the aid of an applied dichromatic layer, diffraction lattice and/or hologram. They are not sufficiently durable from the aspect of user techniques, since they crack and are easily dirtied, beside being expensive to produce.

Transparent material, such as transparent plastic material, has also been used. Among other things, a plastic laminate has been used in an Australian banknote issued in conjunction with the bicentennial celebrations of the colonization. The entire banknote is made of a transparent plastic laminate printed with a white and a coloured ink, wherein part of the surface of the banknote has been left unprinted and thus remain transparent. The plastic banknote is difficult, if not impossible, to reproduce on a colour copier. The print applied to the banknote, however, is unsatisfactory and requires the use of expensive, special equipment, and hence the Australian banknote has not been followed-up. Objections have also been raised against the "plastic-like" impression given by the banknote and also its general appearance.

DISCLOSURE OF THE PRESENT INVENTION

The present invention provides a method of producing visible, continuous streaks and/or delimited fields in paper. The produced paper is characterized in that it has a paper structure, by which is meant that the streaks/fields incorporated in the paper also have a paper structure. In accordance with one particularly preferred aspect of the invention, there is provided a method of producing transparent streaks and/or fields in paper where the transparent and/or partially transparent parts of the paper also have a paper structure, i.e. a fibre structure, and can be printed in conventional printing presses with conventional printing inks, preferably inks intended for security print. The transparent and/or partially transparent parts of the paper thus have physical properties which are similar to the properties of the remaining parts of the paper, with the exception of different optical properties. By transparent paper is meant in the present context that the paper is essentially permeable to light of those wavelengths normally occurrent in conventional illuminating devices. A high transmission value may mean that the light will pass through the material with or without being scattered. There is always a certain amount of scattering, both with regard to the transmitted and the reflected light. The material concerned obtains a more pronounced "window character" when the light passes through the material without being scattered or reflected, as is preferred. On the other hand, when scattering of the transmitted light predominates, the paper obtains a light but milky appearance when looked through. A high transmittance always means low opacity, irrespective of whether the passage of light through the material relates to scattered direct transmitted light. Thus, according to the invention, a low opacity in the streaks/fields incorporated in the paper provide the best conditions for preventing forgery by copying. In order to obtain a sharp and continuous image when looking through the paper, the incident light should not therefore be scattered by irregular reflection, in other words light scattering and also light absorption should be low.

When the paper produced has a paper structure, the paper will be dimensionally stable and strong, i.e. the streaks/fields which differ in some respect and the surrounding areas behave essentially in mutually the same way when the paper is subsequently arbitrarily treated in a conventional manner. Accordingly, the fibre material in the streaks/fields will preferably be dimensionally stable and highly compatible with the paper fibres present in the surrounding areas, so as to avoid deformation of the paper during subsequent treatment and printing.

The inventive method is characterized by preventing the deposit of paper stock/paper fibres on one or more surfaces of the wire of a forming unit in conjunction with forming a paper web in a paper machine, and by introducing to this surface or these surfaces a special stock that contains fibres which differ from the remainder of the cellulosic fibre material deposited on the forming wire. The special stock deposited in one or more streaks or delimited fields may contain an appropriate filler and binding agent, as can also the other paper stock used. The fibre material of the special stock and optionally also the filling and binding agent will preferably differ optically from the other fibre material deposited on the wire. According to one particularly preferred embodiment, the special stock is transparent, although it will be understood that the invention is in no way restricted to producing transparent streaks and/or fields and that fibres which contain special properties may also be used, such as fibres which have a high lustre, colour and also other properties such as fluorescent, photochromatic, thermochromatic, electrical or light-conductive properties. For instance, some transparent fibres can be pre-treated and formed to give a high lustre. This can be achieved, for instance, by giving some of the fibres a rectangular cross-sectional shape, i.e. by flattening the fibres.

Formation of the "naked" wire surface or wire surfaces and the application of the special stock to said surface/surfaces is effected in conjunction with dewatering the remainder of the paper stock in a forming unit, for instance in a cylinder-vat unit. When dewatering with the aid of a cylinder-vat unit, a cylindrical forming unit normally rotates with one wire surface in contact with paper stock. A pressure below ambient pressure is generated in the interior of the cylinder and liquid drained from the stock is drawn through the cylindrical wire and paper fibres deposited on the cylinder as it rotates. Co-couching and binding of the preferably transparent streaks/fields, which differ from the remainder of the paper, and the areas surrounding said streaks/fields is effected in a wet state in conjunction with forming the paper web in the paper machine. According to one particularly preferred embodiment of the invention, the fibre structures in the incorporated fields or streaks are woven together with the fibre structures of the surrounding areas.

In order to obtain a visible deviation or difference in those streaks/fields in which the special stock has been dewatered, it is necessary to keep the wire surface essentially free from other paper stock within this area. This can be achieved in several ways. For instance, there can be used a mechanical device which seals against the wire gauze of the forming unit so as to keep the wire gauze essentially free from paper stock until the special stock has been deposited on the gauze.

The wire surface can also be kept essentially free from other paper stock by introducing dewatering obstacles, preferably transparent dewatering obstacles, whose extension in the plane of the wire gauze is such as to prevent the major part of standard paper fibres being deposited over this area and therewith facilitate the construction of a streak/field of differing appearance. The dewatering obstacles applied to the wire gauze may conveniently have the form of strips or pieces of homogenous and/or fibrous material. They may have a regular or irregular shape and may be in the form of flakes and/or similar forms. They can be formed of optical interference layers. The dewatering obstacles are preferably produced from a material which has a low total reflectance within the visible range, such as a transparent material, although opaque materials which possess distinguishing properties may be used, for instance materials that possess thermochromatic and/or photochromatic properties. In this latter case, the dewatering obstacles will preferably have a geometrically regular shape so that they can be readily identified in the streaks/fields. Preferred shapes are star shapes, square shapes or hexagonal shapes, although other shapes suitable in this context may also be used. The dewatering obstacles may also form a cross-linked, non-woven fibre structure and are applied in the form of a preshaped fibrous web or fibre band of transparent or photochromatic material that has a low total reflectance within the visible range, or a thermochromatic or pigmented material, for instance a material produced from an appropriately modified fibre material of, e.g., cellulose, regenerated cellulose, acrylic or polyvinyl alcohol. Several thermochromatic and photochromatic plastic materials suitable for the intended purpose are available commercially.

When the dewatering obstacles are transparent, partially transparent streaks/fields can be formed as a result of the dewatering obstacles preventing essentially continued dewatering of standard paper stock on the wire gauze and therewith form a transparent streak/field which is bound by a few fibres, preferably transparent fibres. With the intention of improving the strength of the partially transparent streak/field, transparent pulp and/or binder can be supplied to the streak/field or the formed paper web can be subsequently treated, for instance sized, coated, lacquered or the like with transparent material. The paper sheet formed on the wire gauze may also be couched together with one or more other sheets, as discussed below.

An essentially free wire area can also be obtained by mechanically, hydraulically or pneumatically shearing, rinsing, blowing or sucking away a fibre layer that has already been formed on the wire gauze. Rinsing or blowing can be effected by means of air and/or water with an appropriately designed nozzle. Removal of a formed fibre sheet by suction may also be effected with the aid of vacuum conditions. For instance, the construction of a continuous fibre sheet across the full width of the wire gauze can be disturbed and even prevented by one of the aforesaid methods, whereafter pulp that contains special fibres, preferably transparent fibres, is supplied to and dewatered on the "naked" or generally exposed wire gauze.

The inventive method can be carried out by mounting in the immediate vicinity of the place where dewatering is commenced a nozzle which is provided with a closed nozzle part/nozzle lip and which screens and prevents paper stock being deposited on one or more surfaces of the wire gauze of the forming unit while, at the same time, permitting a special stock containing fibres that differ from the cellulosic fibre material deposited on the forming wire to be delivered to said surface or surfaces at the same time. The nozzle will preferably narrow or taper and when cylinder-vat dewatering is applied, the nozzle will preferably have the same radius of curvature as the wire cylinder.

The lip orifice of the nozzle may be configured to produce a streak that contains special stock, although it may also be divided into sections, as discussed below, so that several streaks containing identical or different pulps can be applied simultaneously. In this latter case, the lip orifice includes channels or pipes that seal against the remaining parts of the nozzle and open into the nozzle tip. The channels or pipes are preferably movable across the full width of the nozzle orifice. In this latter case, the forming nozzle has an extension which stretches over essentially the whole width of the paper web or at least over a major part of said web.

When the nozzle is intended to produce a narrow streak, the nozzle part/nozzle lip will have an extension zone having a width of about 1–100 mm, preferably about 3–50 mm and particularly 5–25 mm, and includes an application zone which has a length of about 30–500 mm, preferably 50–300 mm. The length and width of the application zone must, of course, be adapted to the size of the paper machine used, and more particularly to the width of the paper web (which is suitably about 0.5–5 m) and to the size of the dewatering zones. The aforesaid information shall thus only be seen as an example and in no way limits the invention. The width/size of the incorporated streak/field that is actually possible is also governed, among other things, by the fibre length of the special fibres included in the pulp and the properties of the filler and binder mixture, when added, i.e. the strength properties of the streak. The pulp flows and pulp consistencies are appropriately adapted so that the fibres of the streak or streaks incorporated in the paper web are joined with or even woven into the remainder of the paper to form a smooth web. The fibres from the different paper areas of different fibre types are infiltrated, i.e. stick into one another, thereby obtaining an interfibre compactness of great strength. The junctions between different areas of the paper web are sharply defined and essentially jointless. Suitable pulp flows and pulp consistencies can be readily established by the person skilled in this art, with a few introductory tests. However, the pulp consistencies of the special stock and also of the standard paper stock will preferably lie between about 1 and 10 g/l.

When several streaks/fields are to be included in the paper web, the nozzle part of the forming unit will be conveniently divided into sections, by providing several nozzle channels which are distributed over the whole web width of the forming unit or over the major part of said width and which open in the immediate vicinity of the place where dewatering of the standard paper stock is commenced. Different pulp systems can be connected to the different nozzle channels of the forming unit, so as to enable one or more streaks of transparent stock/pulp and optionally one or more streaks of coloured stock/pulp or stock/pulp which differs in some other way to be deposited on the wire gauze of the forming unit together with the standard paper stock.

For the purpose of producing several streaks/fields, the head box of the forming unit may also be divided into sections by means of partition walls. These sections are connected to different pulp systems and at least one section is connected to a pulp/stock system in which the fibre content differs from that of conventional paper pulp.

According to a further aspect of the invention, a two-ply, three-ply or multi-ply paper can be produced with a composition that differs in the thickness direction of the paper. A thinned fibre streak can be formed by one of the aforesaid methods in conjunction with forming the paper, preferably with a high percentage of transparent material in the thinned parts, such as transparent dewatering obstacles. The formed paper web containing the thinned parts is couched together with a transparent sheet which is preferably produced with a varying basis weight, i.e. the basis weight varies over the width of the web so as to "fill-out" the thinned parts in the first paper web. There is thus formed a layered structure which has several delimited material sheets in the thickness direction of the web. In the case of this application, the inlet part of the paper machine can be constructed as a combination of the aforesaid alternatives, i.e. a combination of forming from a nozzle and forming from a head box. The nozzle part and the head-box part of the forming unit can be placed under pressure and controlled independently of one another, so as to obtain the desired distribution of the two flows, i.e. the fibre mixtures.

When the special pulp/stock delivered to the forming wire is intended to produce transparency in the manufactured paper, the special stock will comprise transparent fibres and, when applicable, transparent filler and/or binder. The fibres may be of a synthetic or natural origin or may comprise a mixture of these origins, such as fibres of regenerated cellulose, polyvinyl alcohol, acrylic fibres or the like. Cellulosic fibres and non-cellulosic fibres can be mixed. The stock will preferably have a high percentage of long fibres which can be woven into the surrounding paper stock when wet, this stock being dewatered on the wire gauze at the same time. The transparent fibres will preferably have a length of between about 0.1 and 10 mm, and the percentage of long fibres used, i.e. fibres having a length of about 3–10 mm, will preferably be about 10–90%, preferably about 50–80% .

The fillers used will preferably result in a high pack density, a high density and low pore volume in the sheet and will have wetting properties which permit effective filling of pores with transparent binding agent, i.e. they shall be transparent fibre compatible. The binding agents and fillers will preferably have a structure which will provide a uniform binder distribution in the wet sheet, so as to prevent air inclusions. With the intention of avoiding unnecessary light reflectance, light absorbance and light scattering in the transparent fields/streaks in the paper, i.e. of obtaining high "coherent" light transmission, the binders and fillers used will preferably be essentially permeable to light at those wavelengths normally occurring in conventional illuminating devices, i.e. visible light. The refractive index of the binders and fillers will preferably be highly adapted to the transparent fibre materials used. The person skilled in this art will be able to readily select suitable fillers and binders of inorganic and organic origin that will fulfil the conditions specific to the inventive method, from among those binders and fillers commercially available.

The paper stock that surrounds the transparent streak or streaks is of a kind which is suitable for the manufacture of paper, and then security paper, check paper, in particular. It may be a stock of conventional cellulosic fibre material, preferably a cotton fibre stock. Different mixtures of synthetic and cellulosic fibres may also be used, for instance with additions of synthetic reinforcing fibres. The added fibres will preferably exhibit similar swelling or shrinkage properties as conventional cellulosic fibres.

When transparent streaks/fields are to be formed in the web, it is particularly important that the paper produced is flat and has a smooth surface, so as to avoid unnecessary scattering of light in the paper sheet. Irregularities in the paper produced result in fuzzy and blurred look-through images, which should be avoided to the greatest possible extent. A high "coherent" transmission can also be obtained in the transparent fields/streaks by subjecting the paper to conventional after-treatment processes, such as wet-pressing, drying, sizing and calendaring, and also by swelling, glass transition, melting and chemically dissolving or disintegrating the surface.

The streaks/fields included in the paper will preferably be easy to discover and identify, preferably without needing to use expensive equipment that has been constructed for this purpose. The inventive method also enables a valuable document to be protected, by including several known security elements of a primary or secondary type. In this context, by primary security elements is meant elements which can be seen and easily identified without the aid of special equipment, whereas by secondary security elements is meant elements which are generally invisible and can often only be identified with the aid of special measuring equipment. With the intention of further increasing security, the streaks/fields formed in the paper may be supplemented with different primary and/or secondary security elements, for instance elements that comprise a magnetic, fluorescent, phosphore fluorescent, metallic, reflective, electrically conductive, photoconductive or light scattering material. Furthermore, different types of watermarks may be incorporated in the paper. All of these additional security elevating measures can be effected in conjunction with forming the paper web on the wire cylinder. For instance, a valuable document containing different embedded security elements can be produced in one working step.

The invention will now be described in more detail with reference to exemplifying embodiments thereof and also with reference to the accompanying drawings, in which FIG. 1 illustrates a cylinder-vat paper machine on which paper is manufactured in accordance with the invention and in the forming unit of which machine there is arranged a nozzle which seals mechanically against the rotating wire surface while permitting special stock to be delivered to said wire surface as it rotates;

Figure 1:
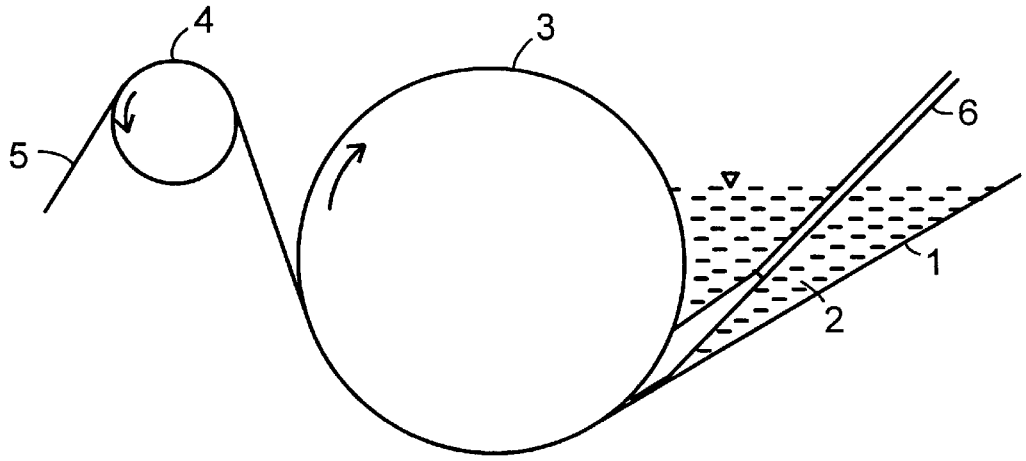

FIG. 1 illustrates a cylinder-type paper machine, for instance a cylinder-vat paper machine comprising a head box (1) which contains paper fibre stock (2) and in which paper fibres are deposited in a forming unit for the manufacture of a paper web. The forming unit is comprised of a wire cylinder (3) which rotates in contact with the paper stock in the head box (1). The internal pressure of the cylinder is lower than the pressure of the surrounding stock and liquid drained from the stock will thus pass through the wire while depositing paper fibres on the cylinder surface as it rotates. The paper thus formed is removed from the wire surface (3) with the aid of a couch roll (4) and forms a fibre/paper web (5) which is supported on a belt. The paper web is transported to a subsequent treatment station or stations, such as a web pressing, drying, sizing, calendaring station, etc., with the intention of elevating transmission in the transparent streaks/fields in the paper, among other things.

So that the inventive method can be put into effect, the forming unit of the paper machine is provided with a nozzle (6) for delivering stock that contains special fibres and optionally also an arbitrary filling and binding agent, preferably a transparent agent. The stock containing the special fibres is delivered to the forming wire in the immediate vicinity of the place where dewatering of the other or standard paper stock (2) is commenced in the forming unit. Dewatering is suitably commenced immediately downstream of a covering cloth arranged in the forming unit. In the FIG. 1 embodiment, the nozzle (6) has a lip which seals against the rotating wire gauze and prevents the deposit of paper fibres on a part of said gauze (3), and has a nozzle part which delivers special stock to the essentially "naked" part of the wire gauze. The forming nozzle (6) presenting said sealing lip and curving towards the wire gauze will preferably have the same radius of curvature as the wire cylinder (3). The lip orifice extends transversely across the whole or part of the width of the paper web and may be sectioned and provided with movable channels which discharge into the nozzle (6) in the immediate vicinity of where the stock flows from the nozzle onto the forming wire (3). The nozzle channels are connected to different stock containers, by means of stock delivery lines (not shown).

Figure 2:
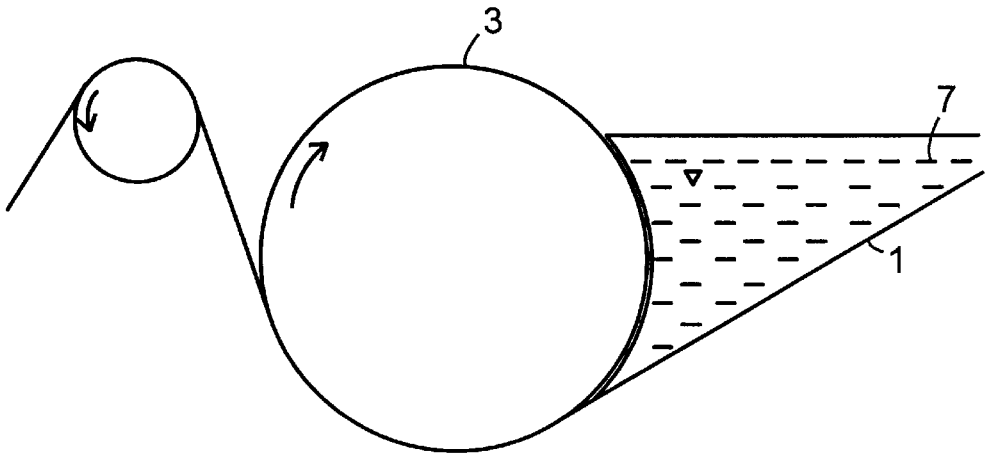
FIG. 2 illustrates a cylinder-vat paper machine having an open section-divided head box which enables several stock mixtures to be delivered simultaneously.

The paper-web pulp flows can also be sectioned by means of a head box (1) that includes partition walls (7), as illustrated in FIG. 2. The head box is connected to different stock containers, by means of delivery lines (not shown).

Figure 3:
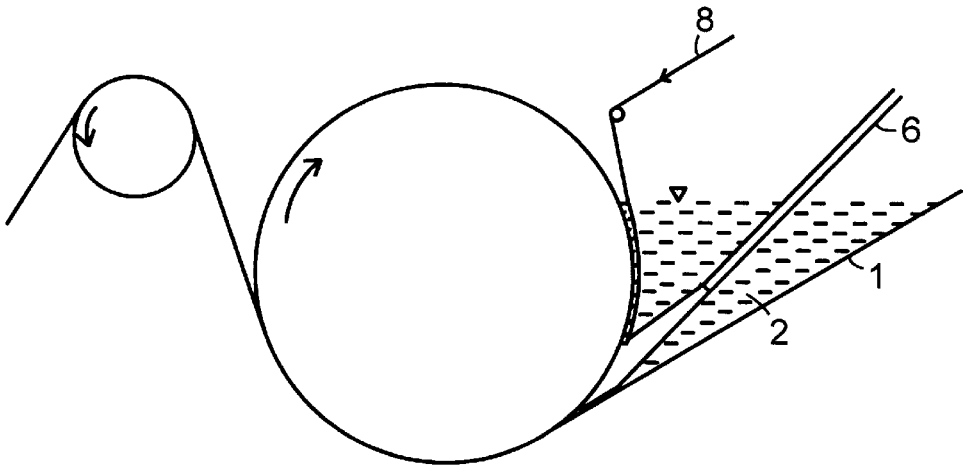
FIG. 3 is a cylinder-vat paper machine in which there is provided in the forming part a nozzle by means of which special stock and dewatering obstacles in the form of fibrous bands can be delivered to the wire surface.

Delivery of dewatering obstacles in the forming zone can be effected by introducing a pre-shaped fibrous strip (8), as illustrated in FIG. 3. A similar arrangement will enable a security element in the form of a continuous thread, filament or strip to be placed in the paper in conjunction with forming the paper web.

Figure 4:
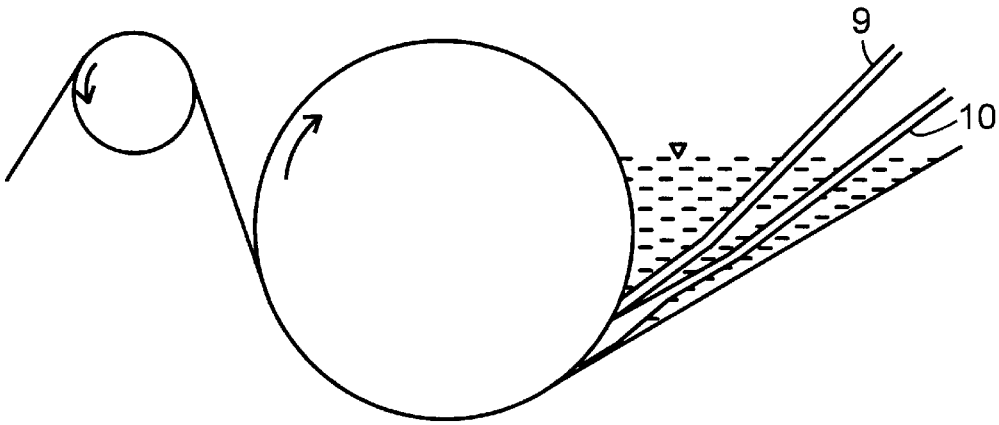
FIG. 4 illustrates a cylinder-vat paper machine in which the forming part is provided with means that shear, rinse or blow-away a fibre sheet that has already been formed on the wire surface.

As illustrated in FIG. 4, a fibre layer that has already been formed on the wire can be removed therefrom with the aid of a nozzle (9) by shearing, rinsing, blowing or sucking away said layer. Special stock can then be introduced through another nozzle (10). Alternatively, the two nozzles (9,10) can be combined to form a single unit.

Figure 5:
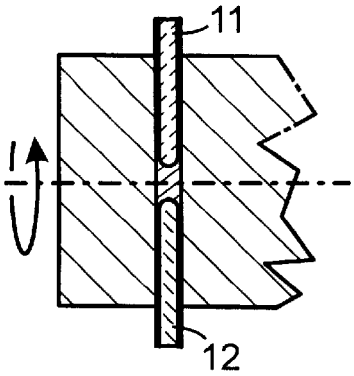
FIG. 5 is a top view of a wire part with which a longitudinally extending streak of transparent pulp is inserted in the forming zone.
Figure 6A:
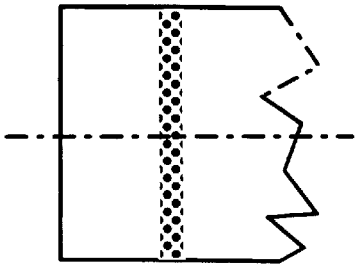
FIGS. 6*a–d* are top views of a wire part with different applied forms of dewatering obstacle which have extension in the plane of the web.
Figure 6B:
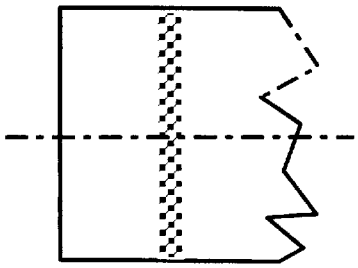
Figure 6C:
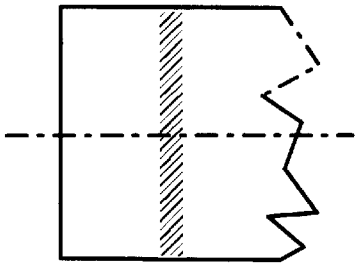
Figure 6D:
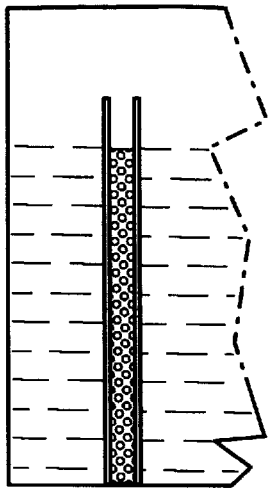

FIG. 5 is a top view of a wire part and shows an essentially "naked" wire surface (11) and an incorporated streak of special stock (12). Dewatering obstacles, which can be embodied in the paper in accordance with an alternative embodiment of the invention, have a regular or irregular flake-shaped for instance (FIG. 6*a*) or may have the form of a continuous net structure (FIGS. 6*b, c*) or a combination of these forms (FIG. 6*d*). The dewatering obstacles may be transparent, opaque and/or exhibit some other special physical property.

EXAMPLE

Cotton stock and different compositions of special stock in consistencies of between 1.5–8.0 g/l was dewatered on a cylinder-vat machine. The stock consistency will be seen from the Table below. The streak produced had a width of between 10–25 mm and the paper had an approximate basis weight of about 80 g/m$^2$. The result of strength tests carried out on the streak are evident from the Table below. It is thought that the results achieved could be improved by adding, for instance, conventional paper chemicals and by subjecting the paper to different after-treatments. Values relating to conventional banknote paper have been given by way of comparison. The banknote paper possesses higher values than the paper which includes the streak and which has been produced from banknote paper stock, containing essentially cotton fibres. These higher values can be explained by the fact that the banknote paper was produced on trimmed equipment with well-tested recipes, and by the fact that the paper had been subjected to conventional after-treatments which enhance the strength of the paper, among other things.

TABLE

| Stock: | | Tensile index along the web | (NM/g)*) across the web | Double fold*) across the web |
|---|---|---|---|---|
| Streak: | | | | |
| Ex. 1 | 81% polyvinyl alcohol fibres (PVA)<br>19% acrylic fibres<br>79% PVA | 79 | 23 | 2000 |
| Ex. 2 | 21% diacetate fibres<br>84% PVA | 57 | 22 | 300 |
| Ex. 3 | 8% acrylic fibres<br>8% diacetate fibres | 68 | 22 | 200 |
| Cf I | 100% cotton fibres | 79 | 26 | 100 |
| Total paper web | | | | |
| Cf II | 100% cotton stock | 70 | 25 | 65 |
| Cf III | Conv. banknote paper | 130 | 40 | 700 |

Nb:
*)average value from several tests.
Tensile testing according to standard method SCAN P:38
Double folding according to standard method TAPPI 423

The results show that the inventive method enables a continuous paper web to be produced with delimited fields and/or continuous streaks of varying sizes, where the streaks produced have a strength of the same order of magnitude as cellulosic paper. The paper produced in accordance with the invention can be used suitably in the manufacture of security documents, particularly banknotes.

I claim:

1. A method of producing a paper web having a visible transparent or translucent region comprising providing a paper stock consisting essentially of opaque fibers and a special stock consisting essentially of transparent or translucent fibers produced from one or more of regenerated cellulose, polyvinyl alcohol or acrylic fibers delivering the paper stock and the special stock on one or more surfaces of a wire in a forming unit of a paper machine together with one or more of a selected filler or binder, said paper stock and said special stock being deposited onto different portions of the wire such that the special stock defines at least one region having a predetermined shape which forms a uniform, predetermined pattern in the paper web, and simultaneously dewatering said paper stock and said special stock deposited on the wire to form a paper web with a substantially constant thickness, the paper stock forming an opaque paper web portion and the special stock forming the defined region as a transparent or translucent web portion extending generally uniformly through the thickness of the paper web whereby duplication of the paper web is rendered more difficult.

2. A method according to claim 1 further comprising providing a paper machine with a head box divided into sections with the aid of partition walls for simultaneous delivery of the paper stock and the special stock onto the wire.

3. A method according to claim 1 wherein said delivering of said special stock is performed with a nozzle, and wherein the special stock is deposited on the wire in the immediate vicinity of where said paper stock and said special stock are dewatered.

4. A method according to claim 1 further comprising couching the paper web produced by said method together with one or more paper webs each produced essentially from stock having a high light transmission value.

5. A method according to claim 1 wherein the filler and/or binder have high light transmission values.

* * * * *